US009212875B1

(12) United States Patent
Huang

(10) Patent No.: US 9,212,875 B1
(45) **Date of Patent: *Dec. 15, 2015**

(54) NOCK BUSHING

(71) Applicant: Dorge O. Huang, Henry, IL (US)

(72) Inventor: Dorge O. Huang, Henry, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/457,139

(22) Filed: Aug. 12, 2014

Related U.S. Application Data

(63) Continuation-in-part of application No. 13/863,440, filed on Apr. 16, 2013, now Pat. No. 8,951,152.

(51) Int. Cl.
*F42B 6/06* (2006.01)

(52) U.S. Cl.
CPC ..... *F42B 6/06* (2013.01)

(58) Field of Classification Search
CPC ..... F42B 6/06; F42B 6/08
See application file for complete search history.

(56) References Cited

U.S. PATENT DOCUMENTS

| | | | | | |
|---|---|---|---|---|---|
| 1,862,259 | A * | 6/1932 | Dunlap | ..... | 493/328 |
| 4,943,067 | A * | 7/1990 | Saunders | ..... | 473/578 |
| 5,067,731 | A * | 11/1991 | Bickel | ..... | 473/578 |
| 5,306,019 | A * | 4/1994 | Guest et al. | ..... | 473/578 |
| 5,417,439 | A * | 5/1995 | Bickel | ..... | 473/578 |
| 5,465,979 | A * | 11/1995 | Buhler | ..... | 473/578 |
| 8,057,330 | B2 * | 11/2011 | Blosser et al. | ..... | 473/582 |
| 8,403,777 | B1 | 3/2013 | Huang | | |
| 8,951,152 | B1 * | 2/2015 | Huang | ..... | 473/578 |

* cited by examiner

*Primary Examiner* — John Ricci
(74) *Attorney, Agent, or Firm* — Donald J. Ersler

(57) ABSTRACT

An improved nock bushing preferably includes a bushing body and a stop flange. The bushing body preferably has a non-round body. An undercut is preferably formed under the stop flange. A nock hole is formed through at least substantially all of a length of the non-round body to receive a projection from an arrow nock. A plurality of lightening openings are preferably formed through the bushing body. The stop flange extends from one end of the bushing body. A distance across the largest cross-section dimension of the bushing body is preferably greater than a diameter of a bushing hole in an arrow shaft. In use, the non-round body is inserted into a nock end of an arrow shaft, which flexes the nock end. The arrow shaft will want to return back to its original round shape and thus applies force to an outer surface of the bushing body.

13 Claims, 2 Drawing Sheets

NOCK BUSHING

CROSS-REFERENCES TO RELATED APPLICATIONS

This is a continuation-in-part patent application taking priority from patent application Ser. No. 13/863,440 filed on Apr. 16, 2013.

BACKGROUND OF THE INVENTION

1. Field of the Invention

The present invention relates generally to archery arrows and more specifically to an improved nock bushing, which provides improved retention of a nock in the end of an arrow shaft.

2. Discussion of the Prior Art

A nock is retained on one end of a nock bushing and the other end of nock bushing is inserted into a nock end of an arrow shaft. Most arrow shafts are fabricated from carbon fiber material. The nock bushing is fabricated from an incompressible metal, such aluminum. Carbon fiber material is nearly incompressible. Retention of a nock bushing in the arrow shaft typically requires the use of an adhesive, cement, glue or the like to secure the nock bushing in the arrow shaft bushing hole. The use of adhesive, cement, glue or the like may reduce the concentricity of the bushing relative to the arrow shaft. U.S. Pat. No. 8,403,777 to Huang discloses an arrow insert with an undercut head.

Accordingly, there is a clearly felt need in the art for an improved bushing, which provides improved retention of a nock bushing in the end of an arrow shaft; ensures concentricity of the nock bushing relative to the arrow shaft and includes a plurality of lightening openings to decrease weight thereof.

SUMMARY OF THE INVENTION

The present invention provides an improved nock bushing, which includes a plurality of lightening openings to decrease weight thereof. A bushing hole is formed in a nock end of an arrow shaft to receive a nock bushing. The improved nock bushing (nock bushing) preferably includes a non-round body and a stop flange. The non-round body preferably has a square shape, but could have a triangular, hexagon, or any other suitable shape. A nock hole is formed through at least substantially all of a length of the non-round body to receive a projection from an arrow nock. A plurality of lightening openings are formed through the non-round body to lighten the weight of the nock bushing.

The stop flange extends from one end of the non-round body to prevent the nock bushing from being inserted too far into an arrow shaft bushing hole. A distance across the largest cross-section dimension of the non-round body is preferably 1-1.5 percent greater than the diameter of the arrow shaft bushing hole, but other percentages may also be used. An undercut is preferably formed under the stop flange, adjacent the non-round body. The undercut has the unexpected result of increasing the life of an arrow shaft.

In use, the non-round body is inserted into the bushing hole, which flexes the end of the arrow shaft. The arrow shaft will want to return back to its original round shape and thus applies force to a portion of an outer perimeter of the non-round body. The force applied will retain the nock bushing in the end of the arrow shaft without the need for adhesive, cement, glue or the like. A centerline of the nock bushing will also be concentric with a centerline of the arrow shaft.

Accordingly, it is an object of the present invention to provide a nock bushing, which does not require adhesive, cement, glue or the like to retain thereof in the end of an arrow shaft.

It is a further object of the present invention to provide a nock bushing, which ensures concentricity of thereof relative to an arrow shaft.

Finally, it is another object of the present invention to provide a nock bushing, which includes a plurality of lightening openings to decrease weight thereof.

These and additional objects, advantages, features and benefits of the present invention will become apparent from the following specification.

DETAILED DESCRIPTION OF THE PREFERRED EMBODIMENTS

Figure 1:
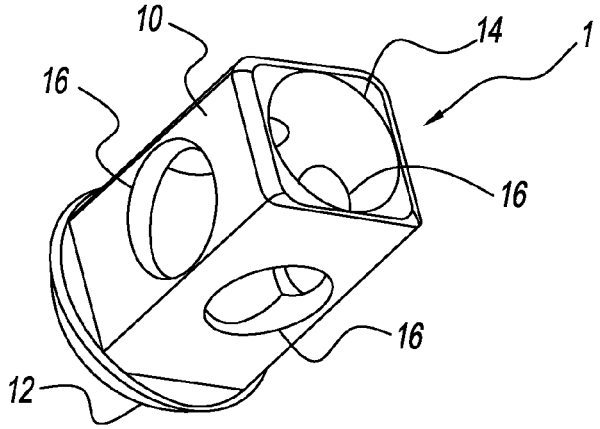
FIG. 1 is a perspective view of a nock bushing in accordance with the present invention.
Figure 2A:
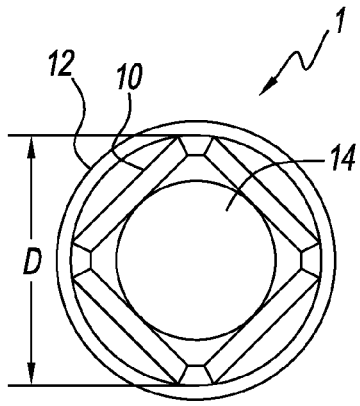
FIG. 2*a* is an end view of a nock bushing in accordance with the present invention.
Figure 3:
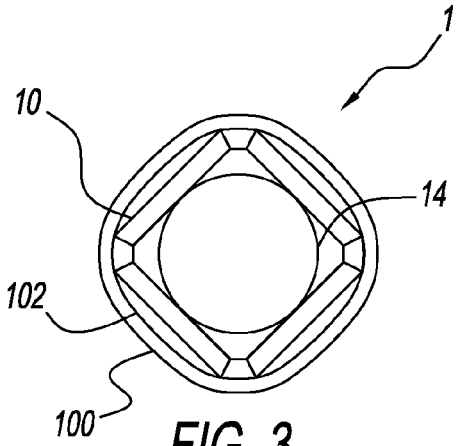
FIG. 3 is an end cross sectional view of a nock bushing retained in an of an arrow shaft in accordance with the present invention.
Figure 2B:
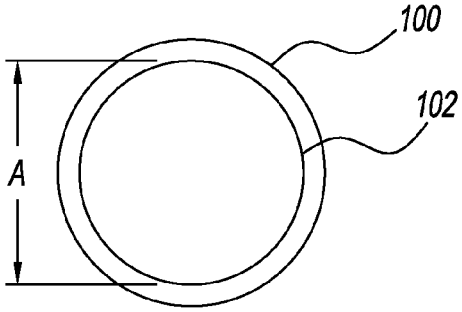
FIG. 2*b* is an end view of an arrow shaft for receiving a nock bushing in accordance with the present invention.
Figure 4:
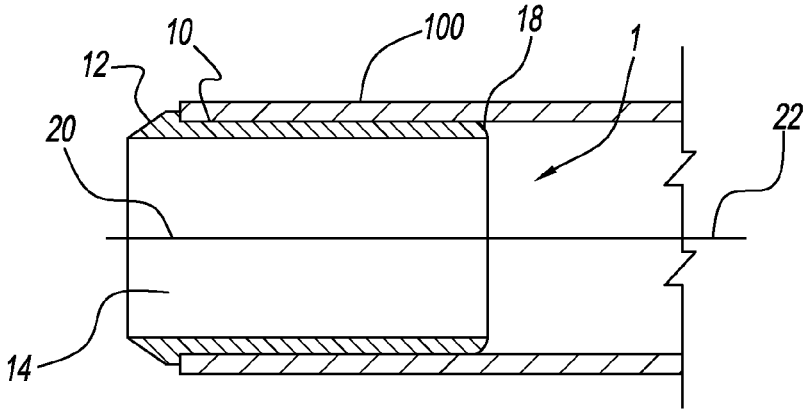
FIG. 4 is a side cross sectional view of a nock bushing retained in an of an arrow shaft in accordance with the present invention.

With reference now to the drawings, and particularly to FIG. 1, there is shown a perspective view of a nock bushing 1. The nock bushing 1 preferably includes a non-round body 10 and a stop flange 12. The non-round body 10 preferably has a square shape, but could have a triangular, hexagon, or any other suitable shape. A nock hole 14 is formed through at least substantially all of a length of the non-round body 10 to receive a projection from an arrow nock. A plurality of lightening openings 16 are formed through the non-round body to lighten the weight of the nock bushing 1.

The stop flange 12 extends from one end of the non-round body 10 to prevent the nock bushing 1 from being inserted too far into a bushing hole 102 of an arrow shaft 100. The other end of the non-round body 10 is preferably broken with a radius 18, chamfer or the like to facilitate insertion into the bushing hole 102. A measurement across the largest cross-section dimension "D" of the non-round body 10 is preferably 1-1.5 percent greater than the diameter "A" of the bushing hole 102, but other percentages may also be used. The dimension "D" has an interference fit with the diameter "A" of the bushing hole 102.

Figure 5:
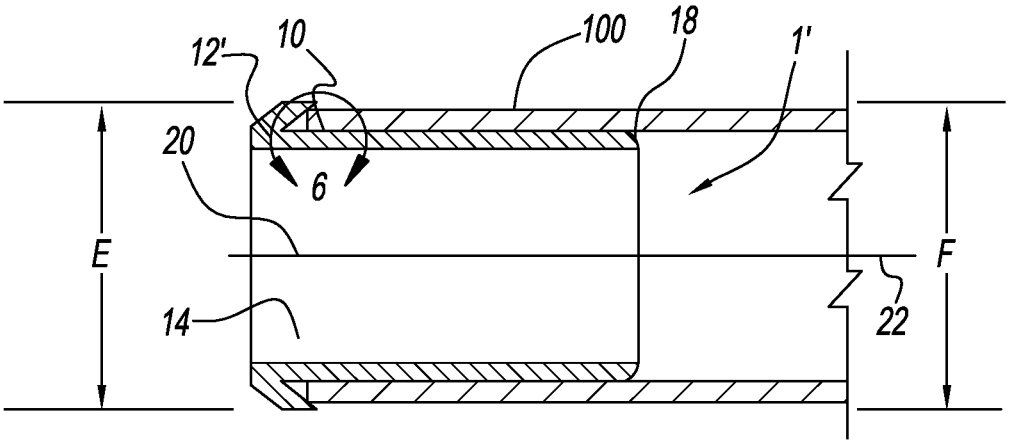
FIG. 5 is an enlarged side cross sectional view of a nock bushing retained in an of an arrow shaft with an undercut formed in a bottom of a stop flange in accordance with the present invention.
Figure 6:
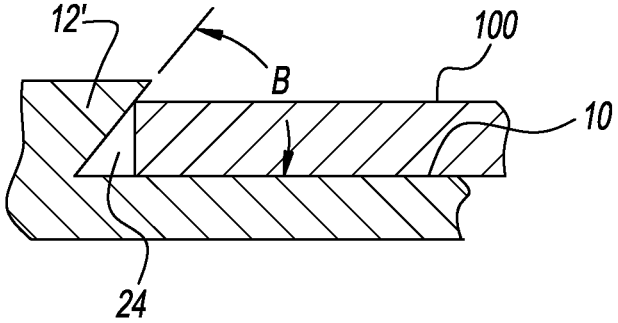
FIG. 6 is an enlarged view of an undercut formed in a stop flange of a nock bushing in accordance with the present invention.

With reference to FIGS. 5-6, a nock bushing 1' preferably includes the non-round body 10 and a stop flange 12'. An undercut 24 is formed in a bottom of the stop flange 12', adjacent an outer perimeter of the non-round body 10. The stop flange 12' includes an outer diameter "E" which is preferably greater than an outer diameter "F" of the arrow shaft 100. The following value is given by way of example and not by way of limitation, the outer diameter "E" is greater than outer diameter "F" by two fifths of a thickness of the arrow shaft 100. The undercut 24 is preferably an angular undercut. The angular undercut includes an acute angle "B," which preferably has a value between 30-60 degrees. However, other shapes of undercuts may also be used, such as curved undercuts. The angular undercut 24 has the unexpected result of increasing the life of the arrow shaft 100.

In use, the non-round body 10 is inserted into the bushing hole 102, which flexes or distorts the round end of the arrow shaft 100. The arrow shaft 100 will want to return back to its original round shape and thus applies force to a portion of an outer perimeter of the non-round body 10. The force applied will retain the nock bushing 1, 1' in the end of the arrow shaft 100 without the need for adhesive, cement, glue or the like. A centerline 20 of the nock bushing 1, 1' will also be concentric with a centerline 22 of the arrow shaft 100.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An improved nock bushing for insertion into a nock end of an arrow shaft comprising:

a non-round body having an outer perimeter, a first end and a second end, a stop flange is formed on said first end of said non-round body, an undercut is formed in a bottom of said stop flange adjacent said outer perimeter, a nock hole is formed through at least substantially all of a length of said non-round body starting at said first end, at least a portion of said outer perimeter having an interference fit with a bushing hole in a nock end of an arrow shaft.

2. The improved nock bushing for insertion into a nock end of an arrow shaft of claim 1 wherein:

said undercut is an angular undercut.

3. The improved nock bushing for insertion into a nock end of an arrow shaft of claim 1 wherein:

one of a radius and a chamfer are formed on said second end of said non-round body.

4. The improved nock bushing for insertion into a nock end of an arrow shaft of claim 1 wherein:

said non-round body having a square shape.

5. The improved nock bushing for insertion into a nock end of an arrow shaft of claim 1 wherein:

an outer perimeter of said stop flange is greater than an outer diameter of the arrow shaft.

6. The decreased weight nock bushing for insertion into a nock end of an arrow shaft of claim 5 wherein:

one of a radius and a chamfer are formed on said second end of said non-round body.

7. The decreased weight nock bushing for insertion into a nock end of an arrow shaft of claim 5 wherein:

said undercut is an angular undercut.

8. The decreased weight nock bushing for insertion into a nock end of an arrow shaft of claim 5 wherein:

an outer perimeter of said stop flange is greater than an outer diameter of the arrow shaft.

9. A decreased weight nock bushing for insertion into a nock end of an arrow shaft comprising:

a non-round body having an outer perimeter, a first end and a second end, a stop flange is formed on said first end of said non-round body, an undercut is formed in a bottom of said stop flange adjacent said outer perimeter, a nock hole is formed through at least substantially all of a length of said non-round body starting at said first end, a plurality of lightening holes being formed through an outer perimeter of said non-round body to decrease weight thereof.

10. An improved nock bushing for insertion into a nock end of an arrow shaft comprising:

a non-round body having an outer perimeter, a first end and a second end, a stop flange is formed on said first end of said non-round body, an undercut is formed in a bottom of said stop flange adjacent said outer perimeter, a nock hole is formed through at least substantially all of a length of said non-round body starting at said first end, a portion of said outer perimeter having an interference fit with a bushing hole in a nock end of an arrow shaft, wherein a shape of said non-round body distorting a round shape of the arrow shaft after insertion into the bushing hole.

11. The improved nock bushing for insertion into a nock end of an arrow shaft of claim 10 wherein:

said undercut is an angular undercut.

12. The improved nock bushing for insertion into a nock end of an arrow shaft of claim 10 wherein:

one of a radius and a chamfer are formed on said second end of said non-round body.

13. The improved nock bushing for insertion into a nock end of an arrow shaft of claim 10 wherein:

an outer perimeter of said stop flange is greater than an outer diameter of the arrow shaft.

* * * * *